United States Patent [19]

Sawa

[11] Patent Number: 4,755,648

[45] Date of Patent: Jul. 5, 1988

[54] CYCLICAL, MULTIPLE FREQUENCY HIGH-FREQUENCY INDUCTION HEATING APPARATUS

[75] Inventor: Kunihiko Sawa, Kanagawa, Japan

[73] Assignee: Fuji Electric Co., Ltd., Kawasaki, Japan

[21] Appl. No.: 37,171

[22] Filed: Apr. 10, 1987

[51] Int. Cl.[4] ..... H05B 6/06

[52] U.S. Cl. ..... 219/10.77; 219/10.43; 219/10.69

[58] Field of Search ..... 219/10.77, 10.75, 10.71, 219/10.43, 492, 10.69

[56] References Cited

U.S. PATENT DOCUMENTS

| | | | |
|---|---|---|---|
| 2,444,259 | 6/1948 | Jordan | 219/10.43 |
| 2,669,647 | 2/1954 | Segsworth | 219/10.71 |
| 3,057,985 | 10/1962 | Biringer | 219/10.75 X |
| 3,436,641 | 4/1969 | Biringer | 219/10.77 X |
| 4,093,839 | 6/1978 | Moliterno et al. | 219/10.71 X |
| 4,420,667 | 12/1983 | Lewis | 219/10.71 X |
| 4,600,823 | 7/1986 | Hiejima | 219/10.77 |

*Primary Examiner*—Philip H. Leung

*Attorney, Agent, or Firm*—Finnegan, Henderson, Farabow, Garrett, and Dunner

[57] ABSTRACT

A high-frequency induction heating apparatus for heating a material includes a voltage source, a high-frequency inverter coupled to the voltage source for feeding an alternating current, and a coil for applying the current to the material to induce eddy currents therein and heat the material. A frequency control device controls the inverter to cyclically feed a first current having a first frequency and a second current having a second frequency higher than the first current to substantially simultaneously heat an inner portion and an outer portion of the material, respectively. The control device also may cyclically switch the voltage level of the output of the inverter between a first voltage level and zero volts to change the power output thereof. The control device apparatus has a switching cycle time that is shorter than the thermal time constant of the material.

4 Claims, 2 Drawing Sheets

CYCLICAL, MULTIPLE FREQUENCY HIGH-FREQUENCY INDUCTION HEATING APPARATUS

FIELD OF THE INVENTION

The present invention relates to an induction heating apparatus that operates with power supplied from a high-frequency inverter. More particularly, the present invention relates to a high-frequency induction heating apparatus which substantially simultaneously heats to different temperatures independently the surface layer and the interior of a material being heated by quickly changing the output frequency and/or the output power of the high-frequency inverter.

BACKGROUND OF THE INVENTION

When a good electrical conductor such as a metal is placed in a high-frequency alternating magnetic field eddy currents are produced in the conductor as a result of electromagnetic induction to cause an "eddy-current loss". If this good conductor is a magnetic material, a hysteresis loss also occurs. As is well known, the high-frequency induction heating apparatus utilizes the heat produced by the eddy-current loss and hysteresis loss.

The so-called "skin effect" produces the eddy currents more concentrated in the surface layer than in the inner portion in the material being heated by induction. The penetration depth of the eddy currents decreases with increasing frequency of the current flowing through the induction heating coil. It is also well known that the eddy-current loss increases with the amount of current flowing through the induction heating coil and with its frequency.

A typical layout of a high-frequency induction heating apparatus is shown schematically in FIG. 1. The heater includes a rectifier 1 for effecting AC to DC conversion, a capacitor for smoothing the resulting DC voltage, an inverter 3 for generating a high-frequency voltage to be supplied to an induction heating coil 4 that is coiled around a material 5 to be heated. The rectifier 1 is necessary only when the high-frequency apparatus receives power from an AC source and, therefore, is not necessary if the apparatus operates on a DC supply. The capacitor 2 is also unnecessary if the ripple voltage resulting from the AC to DC conversion effected in the rectifier 1 can be ignored.

A DC voltage that is obtained either from a three-phase or single-phase power supply after DC-AC conversion in the rectifier 1 and smoothing by the capacitor 2, or from a DC power source, is fed into the high-frequency inverter 3 to produce a high-frequency alternating current that is supplied to the heating coil 4. The resulting eddy currents induced in the material placed within or near the coil produce sufficient thermal energy to heat the material. This is the well-known operating mechanism of a high-frequency induction heating apparatus.

In certain applications of the induction heating technique, such as quenching of steel materials, there exists a need to heat the surface layer and the interior to different temperatures. Conventionally, this need has been met by employing two separate high-frequency induction heaters producing outputs of different voltages and frequencies that are installed side by side and through which a material to be heated is moved such that the surface layer of the material is heated by one unit and the deeper portion of the material is heated by the other unit.

FIG. 2 shows a high-frequency induction heating apparatus that utilizes two induction heater units for the purpose of heating the surface layer and the deeper portion of a material to be heated to different degrees. The first induction heater unit includes a rectifier 11, a capacitor 21, a first high-frequency inverter 31, and a coil 41. The second induction heater unit includes a rectifier 12, a capacitor 22, a second high-frequency inverter 32 that produces an output that is different in power and frequency from the output produced by the first inverter, and a coil 42. The coils 41 and 42 encircle the material 5 to be heated. As the material 5 is moved successively through the coils 41 and 42, it is supplied with different outputs of high-frequency power.

As is apparent from the above explanation, heating with two high-frequency induction heater units requires separate rectifiers and inverters for each unit and hence is expensive.

A less expensive system has been developed and is shown schematically in FIG. 3. In this system, a rectifier 1' and a capacitor 2' are used commonly for two high-frequency inverters 31 and 32. The outputs of an inverter 31 are passed through cross-current suppressing reactors 611 and 612 and supplied to a common coil 4 in which they are superposed on the outputs of another inverter 32 that have been supplied to the coil 4 after passing through cross-current suppressing reactors 621 and 622. This arrangement enables the surface layer and the deeper portion of the material 5 in the coil 4 to be heated to different temperatures because the two power outputs have different frequencies. However, even this system is not very economical since it requires two high-frequency inverters and four cross-current suppressing reactors.

OBJECTS AND SUMMARY OF THE INVENTION

An object, therefore, of the present invention is to use a single high-frequency induction heater unit to heat both a surface layer and an internal portion of a material to different temperatures substantially simultaneously.

Another object of the present invention is a high-frequency induction heater unit having a high-frequency inverter with variable output power or frequency.

These and other objects are attained by a high-frequency inductive heating apparatus for heating a material comprising a voltage source, a high-frequency inverter coupled to the voltage source for feeding an alternating current, means for applying the alternating current to the material to inductively heat the material, a frequency control device for controlling the high-frequency inverter to feed to the means for applying the alternating current a first current having a first frequency to heat an inner portion of the material and a second current having a second frequency higher than the frequency of the first current to heat an outer portion of the material.

BRIEF DESCRIPTION OF THE DRAWINGS

The manner by which the above objects and other objects, features and advantages of the present invention are attained will be fully apparent from the following detailed description when it is considered together with the drawings, wherein.

DETAILED DESCRIPTION

Figure 1:
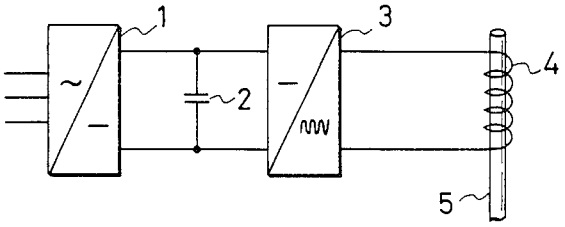
FIG. 1 PRIOR ART
FIG. 1 is a block diagram of a conventional high-frequency induction heating apparatus.
Figure 2:
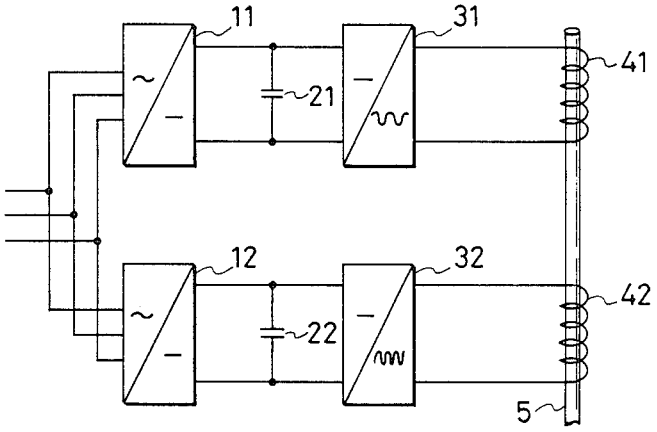
FIG. 2 PRIOR ART
FIG. 2 is a block diagram of a second conventional high-frequency induction heating apparatus.
Figure 3:
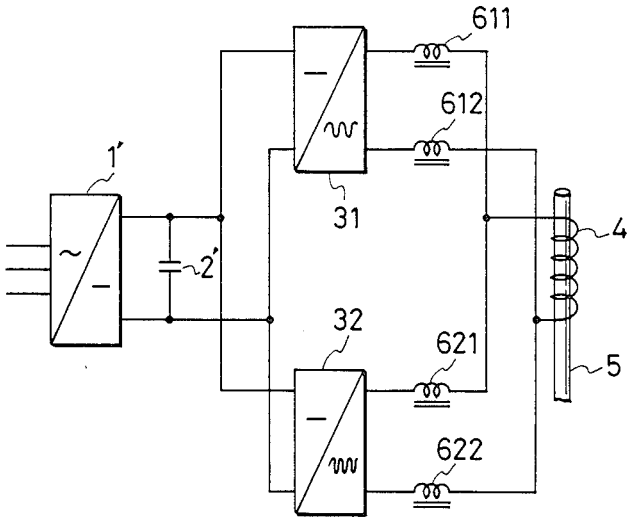
FIG. 3 PRIOR ART
FIG. 3 is a block diagram of a third conventional high-frequency induction heating apparatus.
Figure 6:
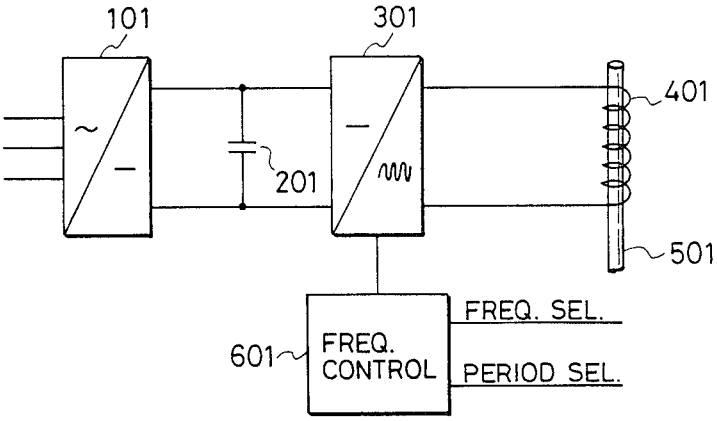
FIG. 6 is a block diagram of the high-frequency induction heating apparatus of the present invention.

An embodiment of the high-frequency induction heating apparatus of the present invention, as illustrated in FIG. 6, is similar to the embodiment of a conventional apparatus shown in FIG. 1 in the regard that a voltage source is provided. The voltage source may be either a direct DC voltage source or a rectifier 101 coupled to a smoothing capacitor 201.

The voltage is supplied to a high-frequency input 301 which supplies high-frequency alternating current to a means for applying the current to the material to inductively heat the material. As embodied herein, the applying means comprises a coil 401 that induces eddy currents in the material 501 placed within or near the coil. As explained above, the eddy currents produce thermal energy to heat a portion of the material corresponding to the frequency of the current.

The apparatus further inc1udes a frequency control device 601 controlling the high-frequency inverter 301 in feeding to the coil 401 a first current having a first frequency to heat an inner portion of the material and a second current having a second frequency higher than the frequency of the first current to heat an outer portion of the material. The frequency control device 601 can be embodied by any suitable circuitry that will control the inverter 301 in feeding a current with more than one selectable frequency on the bases of the input to the control device 601 of a frequency selection signal indicating the frequencies to be selected and a period selection signal indicating the time sequence for feeding the selected frequencies. If the frequency of the output of the high-frequency inverter is changed, the time period for effecting the change is desirably no longer than the thermal time constant of the material to be heated.

Figure 4:
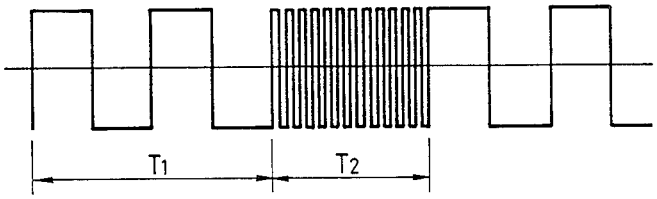
FIG. 4 is a waveform diagram indicating a principle of the high-frequency induction heating apparatus according to the present invention.

According to the present invention, the frequency of the output of a high-frequency inverter is changed cyclically by the control device 601 at appropriate time intervals as shown in FIG. 4 so that heat is generated not only in the surface layer but also in a deeper portion of a material 501 to be heated. If the apparatus is operating on a low frequency, the material 501 can be heated to a certain depth beneath the surface, and if it is operating on high-frequency only the surface layer of the material 501 is heated. The frequency control 601 controls the inverter 301 to switch from one frequency to the other at a time interval that is no longer than the thermal time constant of the material to be heated. Thus, the material can be heated as if it was being heated simultaneously with two different but continuous frequencies.

Figures 5A, 5B:
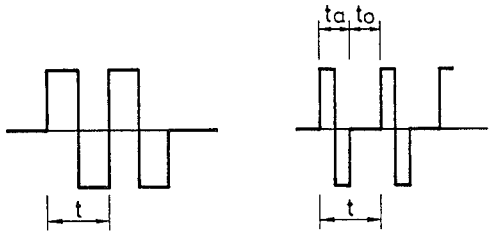
Figs. 5(*a*) and 5(*b*) are waveform diagrams indicating additional principles of the high-frequency induction heating apparatus of the present invention.

If it is desired to control not only the frequency but also the energy injected into the material being heated, voltage control may be effected by using the rectifier 101 as a thyristor inverter. However, for economic reasons, voltage control is better effected with the control device 601 by controlling the inverter 301 so that the inverter 301 feeds voltage that changes as illustrated in FIGS. 5(*a*) or (*b*) In FIG. 5(*a*), the inverter 301 is operated with current being applied in opposite directions for alternating time intervals of t/2. An alternative method for realizing an output voltage-controlled inverter is shown in FIG. 5(*b*). The current is supplied for a selectable period $t_a$ and is inhibited for a period $t_o$ during which no output is produced. The sum of $t_a$ and $t_o$ is the full period t. By controlling the length of the "zero-output period" $t_o$ from 0 to t control of the output voltage of the inverter can be accomplished.

Instead of controlling the output voltage of the inverter 301, the ratio of the period during which a low-frequency output is produced relative to the period during which a high-frequency output is produced (T1/T2 in FIG. 4) may be controlled to realize an inexpensive apparatus that feeds selected energy into an outer portion and an inner portion of a material.

The foregoing description assumes the case in which the frequency of the output of a high-frequency inverter is switched from a low level to a high level, or vice versa, at cyclical time intervals. It should be understood that the objects of the present invention can be satisfactorily attained even when frequency change is effected for three or more different frequencies.

What is claimed is:

1. A high-frequency induction heating apparatus for heating a material having a characteristic thermal time constant, comprising:

a voltage source;

a high-frequency inverter coupled to the voltage source for outputting an alternating current;

a coil means, coupled to said high frequency inverter, for inducing eddy currents in said material; and a frequency control device for controlling said high-frequency inverter to output to said coil means a first current having a first frequency to inductively heat an inner portion of the material and a second current having a second frequency higher than said first frequency to heat an outer portion of the material, wherein said frequency control device controls said inverter to cyclically switch between said first frequency and said second frequency at a frequency with a period less than the thermal time constant of the material to be heated.

2. A high-frequency induction heating apparatus for heating a material having a characteristic thermal time constant comprising:

a voltage source;

a high-frequency inverter coupled to said voltage source for outputting an alternating current;

a coil means, coupled to said high frequency inverter, for inducing addy currents in said material;

a frequency control device for controlling said high-frequency inverter to cyclically vary the frequency of said alternating current output by said inverter between a first frequency for a first time period and a second frequency for a second time period, said first and second time periods having respective durations less than the thermal time constant of said material; and means for adjusting at least one of said first and second time periods.

3. A high frequency induction heating apparatus according to claim 2, wherein said adjusting means includes means to control said first and second time periods at respective durations wherein the ratio between said first time period and said second time period equals a predetermined constant value.

4. A method for high-frequency induction heating of a material having a characteristic thermal time constant, comprising the steps of:

outputting a high frequency signal with a high frequency inverter;

applying the output of the high frequency inverter to the material to inductively heat the material;

causing the inverter to produce a first frequency to inductively heat an inner portion of the material;

causing the inverter to produce a second frequency to inductively heat an outer portion of the material; and repeating the previous two steps sequentially and cyclically at a frequency with a period less than the thermal time constant.

* * * * *